US008647080B2

(12) United States Patent
Tsubai et al.

(10) Patent No.: US 8,647,080 B2
(45) Date of Patent: Feb. 11, 2014

(54) MOTOR-DRIVEN COMPRESSOR

(75) Inventors: Shinji Tsubai, Kariya (JP); Ken Suitou, Kariya (JP); Kosaku Tozawa, Kariya (JP)

(73) Assignee: Kabushiki Kaisha Toyota Jidoshokki, Kariya-Shi (JP)

( * ) Notice: Subject to any disclaimer, the term of this patent is extended or adjusted under 35 U.S.C. 154(b) by 391 days.

(21) Appl. No.: 13/070,857

(22) Filed: Mar. 24, 2011

(65) Prior Publication Data

US 2011/0243764 A1 Oct. 6, 2011

(30) Foreign Application Priority Data

Mar. 31, 2010 (JP) ..... 2010-082927

(51) Int. Cl.
*F04B 17/03* (2006.01)
*F16L 3/08* (2006.01)
*H01R 4/24* (2006.01)

(52) U.S. Cl.
USPC ..... 417/360; 248/65; 248/638; 439/435

(58) Field of Classification Search
USPC ..... 417/360, 361, 363, 572; 248/65, 74.1, 248/74.2, 74.3, 635, 638; 439/345
See application file for complete search history.

(56) References Cited

U.S. PATENT DOCUMENTS 2,751,147 A * 6/1956 Wurtz ..... 417/363
4,600,367 A * 7/1986 Terauchi et al. ..... 417/360
4,766,968 A * 8/1988 Matsunaga ..... 180/68.4
4,834,336 A * 5/1989 Shimazaki et al. ..... 248/666
4,938,448 A * 7/1990 Shimazaki ..... 248/635
4,988,071 A * 1/1991 Shimazaki et al. ..... 248/666
4,993,682 A * 2/1991 Imai et al. ..... 248/638
5,620,741 A * 4/1997 Duffy et al. ..... 427/181
6,233,140 B1 * 5/2001 Cummings et al. ..... 361/679.55
6,669,452 B2 * 12/2003 Ogawa et al. ..... 417/360
6,705,581 B2 * 3/2004 Trago et al. ..... 248/656
2002/0100855 A1 * 8/2002 Zupan et al. ..... 248/674
2002/0131878 A1 * 9/2002 Ogawa et al. ..... 417/360
2005/0178604 A1 * 8/2005 Burnham ..... 180/312

(Continued)

FOREIGN PATENT DOCUMENTS

CN 101147003 A 3/2008
JP 64-044810 U 3/1989

(Continued)

OTHER PUBLICATIONS

JP2000130330A_MachineTranslation.*

(Continued)

*Primary Examiner* — Charles Freay
(74) *Attorney, Agent, or Firm* — Yoshida & Associates, LLC

(57) ABSTRACT

The motor-driven compressor is mounted on a first mounting of a vehicle. The motor-driven compressor includes a compressor body, a second mounting, a first spacer, a flexible conductor and a fastener. The compressor body is electrically powered to draw in fluid for compression and to discharge the compressed fluid. The second mounting is formed on the compressor body and has a mounting hole. The first spacer is made of a resin and interposed between the first mounting and the second mounting. The conductor is formed integrally with the first spacer for electrically connecting the first mounting and the second mounting. The fastener is made of a resin and inserted through the mounting hole of the second mounting for joining the first mounting and the second mounting.

10 Claims, 5 Drawing Sheets

(56) References Cited

U.S. PATENT DOCUMENTS

| | | | | |
|---|---|---|---|---|
| 2009/0060754 | A1 | 3/2009 | Matsumura | |
| 2010/0224664 | A1* | 9/2010 | Hishinuma et al. | 224/555 |
| 2011/0243763 | A1* | 10/2011 | Suitou et al. | 417/363 |
| 2011/0243765 | A1* | 10/2011 | Sugiyama et al. | 417/363 |
| 2011/0243767 | A1* | 10/2011 | Tozawa et al. | 417/410.1 |
| 2012/0076680 | A1* | 3/2012 | Bahmata et al. | 417/572 |
| 2012/0214328 | A1* | 8/2012 | Downing | 439/345 |
| 2012/0251350 | A1* | 10/2012 | Suitou et al. | 417/363 |
| 2012/0251357 | A1* | 10/2012 | Yokoi et al. | 417/410.1 |

FOREIGN PATENT DOCUMENTS

| | | | | | |
|---|---|---|---|---|---|
| JP | 64-44815 | U | | 3/1989 | |
| JP | 11-257091 | A | | 9/1999 | |
| JP | 11-309783 | A | | 11/1999 | |
| JP | 2000-130330 | A | | 5/2000 | |
| JP | 2000130330 | A | * | 5/2000 | F04B 39/00 |
| JP | 2005-220855 | A | | 8/2005 | |
| JP | 2005-220856 | A | | 8/2005 | |
| JP | 2005220855 | A | * | 8/2005 | F04B 39/00 |
| JP | 2006-022742 | A | | 1/2006 | |
| JP | 2006022742 | A | * | 1/2006 | F02B 77/00 |

OTHER PUBLICATIONS

JP2005220855A_MachineTranslation.*

JP2006022742A_MachineTranslation.*

Chinese Office Action with English Translation for Chinese Patent Application No. 201110083639.7 mailed on Apr. 23, 2013.

* cited by examiner

MOTOR-DRIVEN COMPRESSOR

BACKGROUND OF THE INVENTION

The present invention relates to a motor-driven compressor and more particularly to a motor-driven compressor mounted on a vehicle.

Hybrid vehicle that is powered by both engine and electric motor varies the ratio of engine drive to motor drive in accordance with the running condition of the vehicle. In such a hybrid vehicle, if a compressor that operates a refrigeration cycle of an air conditioner is driven by the engine of the vehicle, the compressor cannot obtain necessary drive force constantly from the engine. In a hybrid vehicle, therefore, a compressor that is driven by electric power from a battery mounted on the vehicle is used. Such a motor-driven compressor is mounted on the body or engine of the vehicle.

The compressor is driven only by the electric motor when the engine is at a stop, such as during an idle stop. When the motor-driven compressor is driven with the engine at a stop, noise is developed due to the operation of the motor-driven compressor. Main cause of the noise development is the resonance due to the vibration of the body or engine caused by the vibration of the motor-driven compressor transmitted via its mounting rather than the sound radiated from the motor-driven compressor. Various mountings for a motor-driven compressor have been proposed to reduce the vibration transmission from the compressor to the body or engine of the vehicle.

Japanese Patent Application Publication No. 64-44815 discloses a structure for mounting a compressor to an engine block or mounting bracket by screws that are inserted through holes formed through the respective mountings of the compressor and screwed into the threaded holes in the engine block. Each of the through-holes in the mounting is larger in diameter than the screw and has therein a cylindrical sleeve through which the screw can be inserted. The through-hole and the cylindrical sleeve have therebetween a rubber vibration isolator inserted by any suitable means such as adhesion or press fitting. The mountings of the compressor are fixed to the engine block by interposing a rubber member between each mounting of the compressor and the engine block and also between the mounting and the head of each screw and then screwing each screw into the threaded hole of the mounting via the rubber member and the through-hole.

If a motor-driven compressor is used as the compressor of the above-referenced publication, it needs to be grounded to the body or engine of the vehicle. However, the motor-driven compressor and the engine block are electrically insulated by the rubber members interposed between the mountings of the motor-driven compressor and the engine block. For the grounding, the motor-driven compressor and the body or engine need to be connected by a grounding cable. Therefore, the compressor of the above-referenced publication requires an extra assembling process for connecting the grounding cable to the motor-driven compressor, thus increasing the manufacturing cost of the compressor.

The present invention is directed to a motor-driven compressor which reduces the cost for grounding the compressor while reducing the noise development.

SUMMARY OF THE INVENTION

In accordance with a first aspect of the present invention, the motor-driven compressor is mounted on a first mounting of a vehicle. The motor-driven compressor includes a compressor body, a second mounting, a first spacer, a flexible conductor and a fastener. The compressor body is electrically powered to draw in fluid for compression and to discharge the compressed fluid. The second mounting is formed on the compressor body and has a mounting hole. The first spacer is made of a resin and interposed between the first mounting and the second mounting. The conductor is formed integrally with the first spacer for electrically connecting the first mounting and the second mounting. The fastener is made of a resin and inserted through the mounting hole of the second mounting for joining the first mounting and the second mounting.

In accordance with a second aspect of the present invention, the motor-driven compressor is mounted on a first mounting of a vehicle. The motor-driven compressor includes a compressor body, a second mounting, a first spacer, a flexible conductor, a fastener and a second spacer. The compressor body is electrically powered to draw in fluid for compression and to discharge the compressed fluid. The second mounting is formed on the compressor body and has a mounting hole. The first spacer is made of a resin and interposed between the first mounting and the second mounting. The conductor is formed integrally with the first spacer for electrically connecting the first mounting and the second mounting. The fastener is inserted through the mounting hole of the second mounting for joining the first mounting and the second mounting. The second spacer is made of a resin and interposed between the second mounting and the fastener.

In accordance with a third aspect of the present invention, the motor-driven compressor is mounted on a first mounting of a vehicle. The motor-driven compressor includes a compressor body, a second mounting, a first spacer, a flexible conductor, a first fastener and a second fastener. The compressor body is electrically powered to draw in fluid for compression and to discharge the compressed fluid. The second mounting is formed on the compressor body and has a mounting hole. The first spacer is made of a resin and interposed between the first mounting and the second mounting. The conductor is formed integrally with the first spacer for electrically connecting the first mounting and the second mounting. The first fastener is inserted through the mounting hole of the second mounting for joining the first spacer and the second mounting. The second fastener is provided for joining the first mounting and the first spacer.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE EMBODIMENTS

The following will describe the embodiments of the present invention with reference to the accompanying drawings. The motor-driven compressor 101 according to the first embodiment of the present invention will be described with reference to FIGS. 1 and 2.

Figure 1:
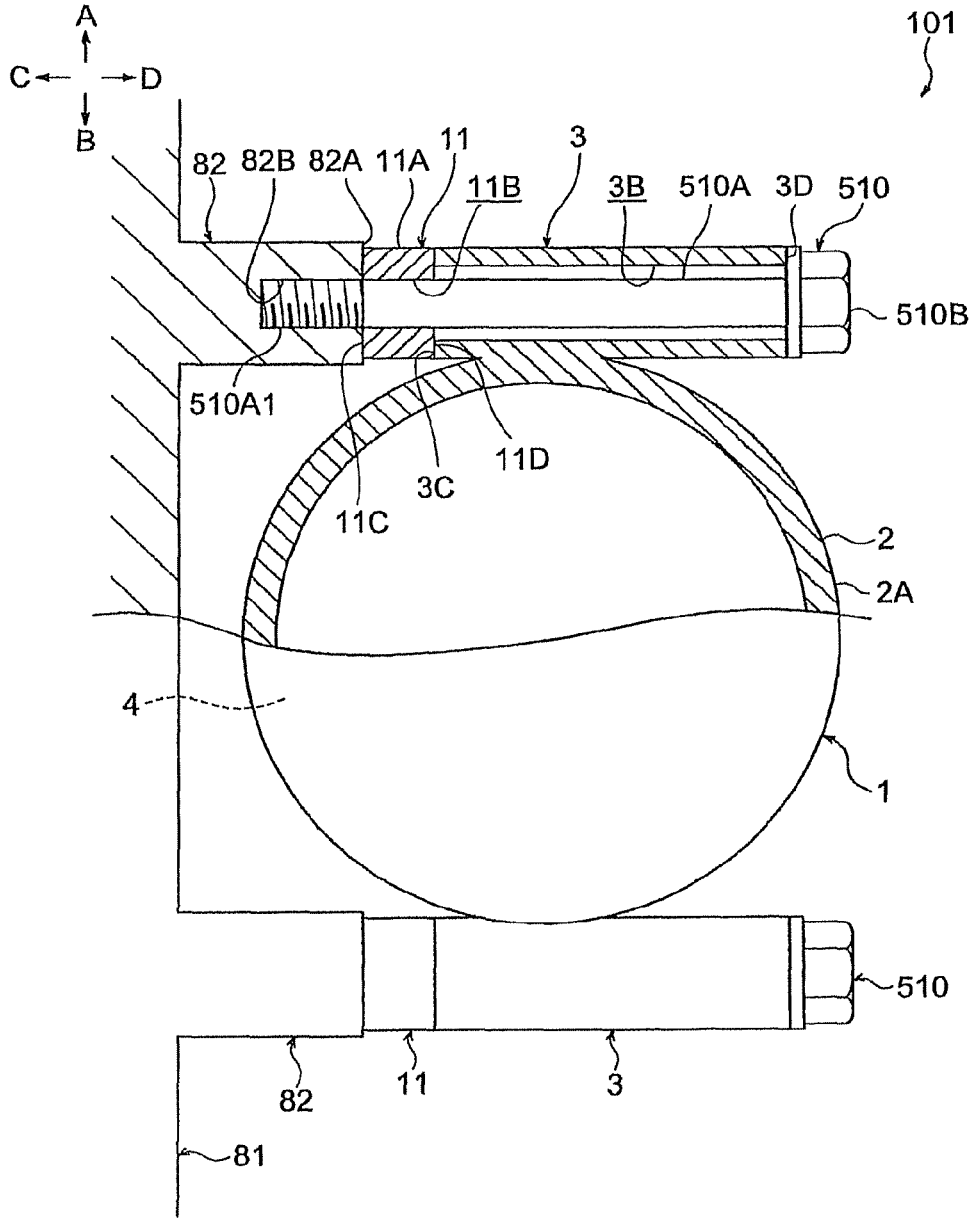
FIG. 1 is a schematic view showing a motor-driven compressor according to a first embodiment of the present invention.

Referring to FIG. 1 showing the motor-driven compressor 101 in schematic view, it is mounted on an internal combustion engine 81 installed in a vehicle. The motor-driven compressor 101 includes a compressor body 1 having a substantially cylindrical housing 2 and a fluid compression mechanism 4 covered by the housing 2. The housing 2 is made of a metal such as aluminum alloy. The fluid compression mechanism 4 is electrically powered, and draws in fluid such as refrigerant for compression and discharges the compressed fluid. The motor-driven compressor 101 includes a pair of cylindrical mounting tubes 3 formed integrally with the housing 2 on the opposite sides of the outer circumferential surface 2A of the housing 2. Each mounting tube 3 is made of the same material as the housing 2. The mounting tube 3 has axially therethrough a mounting hole 3B. The mounting tube 3 is formed with the housing 2 in such an orientation that the axial direction of the mounting hole 3B is perpendicular to the axial direction of the housing 2. The mounting tubes 3 serve as the second mounting of the present invention.

For the sake of convenience of explanation, the direction from the bottom to the top on each drawing is referred to as upward direction A, the direction from the top to the bottom is referred to as downward direction B, the direction from the right to the left is referred to as leftward direction C, and the direction from the left to the right is referred to as rightward direction D.

The mounting tube 3 of the motor-driven compressor 101 has at the left end 3C thereof a cylindrical first spacer 11. The first spacer 11 is made of a resin having a high vibration damping performance and a high rigidity. The resin of the first spacer 11 has a bending elastic modulus of not less than 100 MPa and not more than 10000 MPa. The resin of the first spacer 11 includes PP (polypropylene), PBT (polybutylene terephthalate or PBT resin), PVC (vinyl chloride resin or polyvinyl chloride), PUR (polyurethane), PTFE (fluororesin), PF (phenolic resin), PC (polycarbonate), PA (polyamide or nylon), ABS (ABS resin), carbonaceous resin and any combinations of these materials. The resin of the first spacer 11 also includes fiber-reinforced plastic (FRP).

The loss factor of the resin of the first spacer 11 that represents the vibration damping performance is greater than that of the metal that forms the mounting tube 3. The loss factor preferably ranges between 0.01 and 1. Incidentally, the loss factor of aluminum alloy that metal forms the mounting tube 3 is 0.0001.

Figure 2:
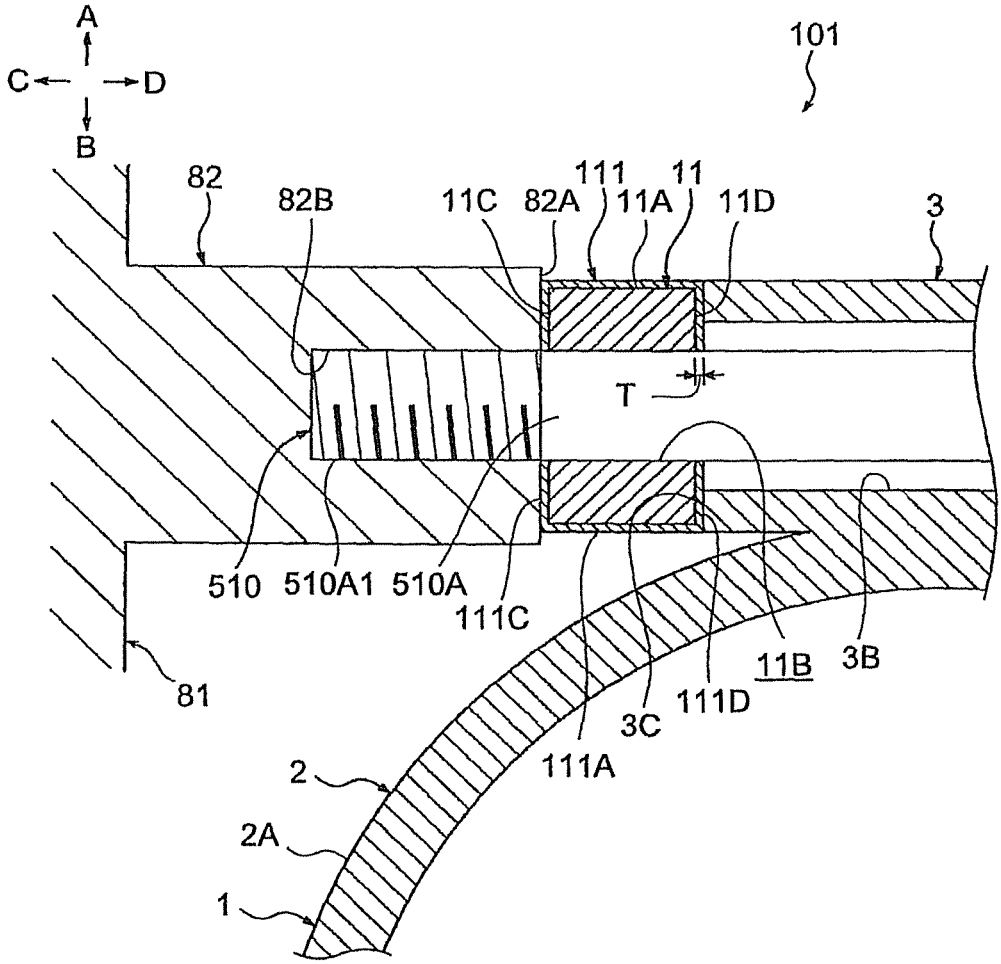
FIG. 2 is a sectional view showing a first spacer of the motor-driven compressor of FIG. 1 and its related parts.

Referring to FIG. 2 showing the first spacer 11 and its related parts in sectional view, the first spacer 11 has axially therethrough a hole 11B. The first spacer 11 has a left end 11C, an outer circumferential surface 11A, a right end 11D and a metal film 111 that is formed over the left end 11C, the outer circumferential surface 11A and the right end 11D. The metal film 111 is electrically conductive. The metal film 111 has a first end portion 111C covering the left end 11C of the first spacer 11, an outer circumferential portion 111A covering the outer circumferential surface 11A and a second end portion 111D covering the right end 11D. The first end portion 111C, the outer circumferential portion 111A and the second end portion 111D of the metal film 111 are continuously formed. The metal film 111 is preferably formed with a thickness T of about 0.1 mm to about 0.5 mm so as to have flexibility and low rigidity. The metal film 111 is formed integrally with the first spacer 11 by resin molding such as insert molding. The metal films 111 serve as the conductor of the present invention.

Referring back to FIG. 1, the engine 81, which is installed in the vehicle and on which the motor-driven compressor 101 is mounted, is formed with cylindrical mountings 82 to which the motor-driven compressor 101 is mounted. Each mounting 82 has at the right end thereof a mounting surface 82A and has therein an internally threaded hole 82B. The mountings 82 serve as the first mounting of the present invention.

The motor-driven compressor 101 is mounted on the engine 81 by fixing the mounting tubes 3 to the mountings 82 of the engine 81. To fix the mounting tube 3 to the mounting 82, a fastener 510 such as a screw having on the shank 510A thereof an external thread 510A1 is inserted through the mounting hole 3B of the mounting tube 3 and the hole 11B of the first spacer 11 that is interposed between the left end 3C of the mounting tube 3 and the mounting surface 82A of the mounting 82. The fastener 510 is further screwed into the internally threaded hole 82B of the mounting 82 and tightened. The fastener 510 is made of a resin which can be used for the first spacer 11.

Referring to FIG. 1 together with FIG. 2, with the mounting tube 3 fixed in place to the mounting 82, the right end 3D of the mounting tube 3 is in contact with the head 510B of the fastener 510 and the left end 3C of the mounting tube 3 is in contact with the right end 11D of the first spacer 11 via the second end portion 111D of the metal film 111. In addition, the left end 11C of the first spacer 11 is in contact with the mounting surface 82A of the mounting 82 via the first end portion 111C of the metal film 111. The mounting tube 3 and the first spacer 11 receive the fastening force of the fastener 510. The mounting tube 3 is electrically connected to the mounting 82 of the engine 81 via the second end portion 111D, the outer circumferential portion 111A and the first end portion 111C of the metal film 111.

The following will describe the operation of the motor-driven compressor 101 with reference to FIGS. 1 and 2. When the motor-driven compressor 101 is started, the fluid compression mechanism 4 covered by the housing 2 is operated and the housing 2 is vibrated, accordingly.

The vibration of the housing 2 is partially transmitted through the mounting tube 3 to the fastener 510 having a high vibration damping performance, where the vibration is dampened. The rest of the vibration of the housing 2 is transmitted to the metal film 111. Because the metal film 111 has a small thickness T and low rigidity, the vibration transmitted to the metal film 111 is further transmitted to the first spacer 11 via the metal film 111. The vibration transmitted to the first spacer 11 is dampened in the first spacer 11 having a high vibration damping performance. Thus, the vibration of the housing 2 is hard to be transmitted to the mounting 82 and hence to the engine 81 and to the body of the vehicle via the engine 81. The first spacer 11 and the fastener 510 which are made of a resin whose bending elastic modulus is not less than 100 MPa and not more than 10000 MPa resist deformation due to the vibration of the housing 2 and the mounting tube 3 and, therefore, the housing 2 remains in place without being displaced. Thus, the amplitude of the vibration of the housing 2 is prevented from increasing.

Referring to FIG. 2, any electric charge generated in the housing 2 by the fluid compression mechanism 4 is allowed to flow to the metal film 111 via the mounting tube 3. The electric charge flowing through the metal film 111 flows to the engine 81 via the mounting 82 and then to the body of the vehicle. Thus, the metal films 111 serve to ground the motor-driven compressor 101.

As described above, the motor-driven compressor 101 of the first embodiment is mounted to a pair of the mountings 82 of the engine 81. The motor-driven compressor 101 includes the compressor body 1, a pair of the mounting tubes 3, a pair of the first spacers 11, a pair of the metal films 111 and a pair of the fasteners 510. The compressor body 1 is electrically powered to draw in fluid for compression and to discharge the compressed fluid. Each mounting tube 3 is formed on the compressor body 1 and has a mounting hole 3B. Each first spacer 11 is made of a resin and interposed between its corresponding mounting 82 and the mounting tube 3. Each metal film 111 is formed integrally with the first spacer 11 for electrically connecting the mounting 82 and the mounting tube 3. In addition, the metal film 111 is flexible and electrically conductive. Each fastener 510 is inserted through the mounting hole 3B of the mounting tube 3 in the mounting 82 for joining the mounting 82 and the mounting tube 3 together. The fastener 510 is made of a resin.

Thus, the vibration developed by the compressor body 1 is transmitted to the first spacer 11 and the fastener 510 via the mounting tube 3. The first spacer 11 and the fastener 510 are both made of a resin having a high vibration damping performance. Therefore, the vibration transmitted to the first spacer 11 and the fastener 510 is dampened and hardly transmitted to the mounting 82. Thus, the vibration transmission from the motor-driven compressor 101 to the engine 81 is reduced and, therefore, the vibration transmission to the vehicle having the engine 81 is also reduced. Consequently, resonance of the vehicle is reduced. The metal film 111 formed integrally with the first spacer 11 provides electrical connection between the mounting tube 3 and the mounting 82 thereby to connect the compressor body 1 and the engine 81, so that the metal film 111 serves to ground the motor-driven compressor 101. Therefore, grounding of the motor-driven compressor 101 is accomplished easily and the manufacturing cost of the motor-driven compressor 101 is reduced.

In the motor-driven compressor 101 wherein the bending elastic modulus of the resin of the first spacer 11 and the fastener 510 is not less than 100 MPa and not more than 10000 MPa, the mounting tube 3 is rigid enough to maintain the mounting tube 3 and the compressor body 1 in place without being displaced, which prevents the amplitude of the vibration of the compressor body 1 from increasing.

Figure 3:
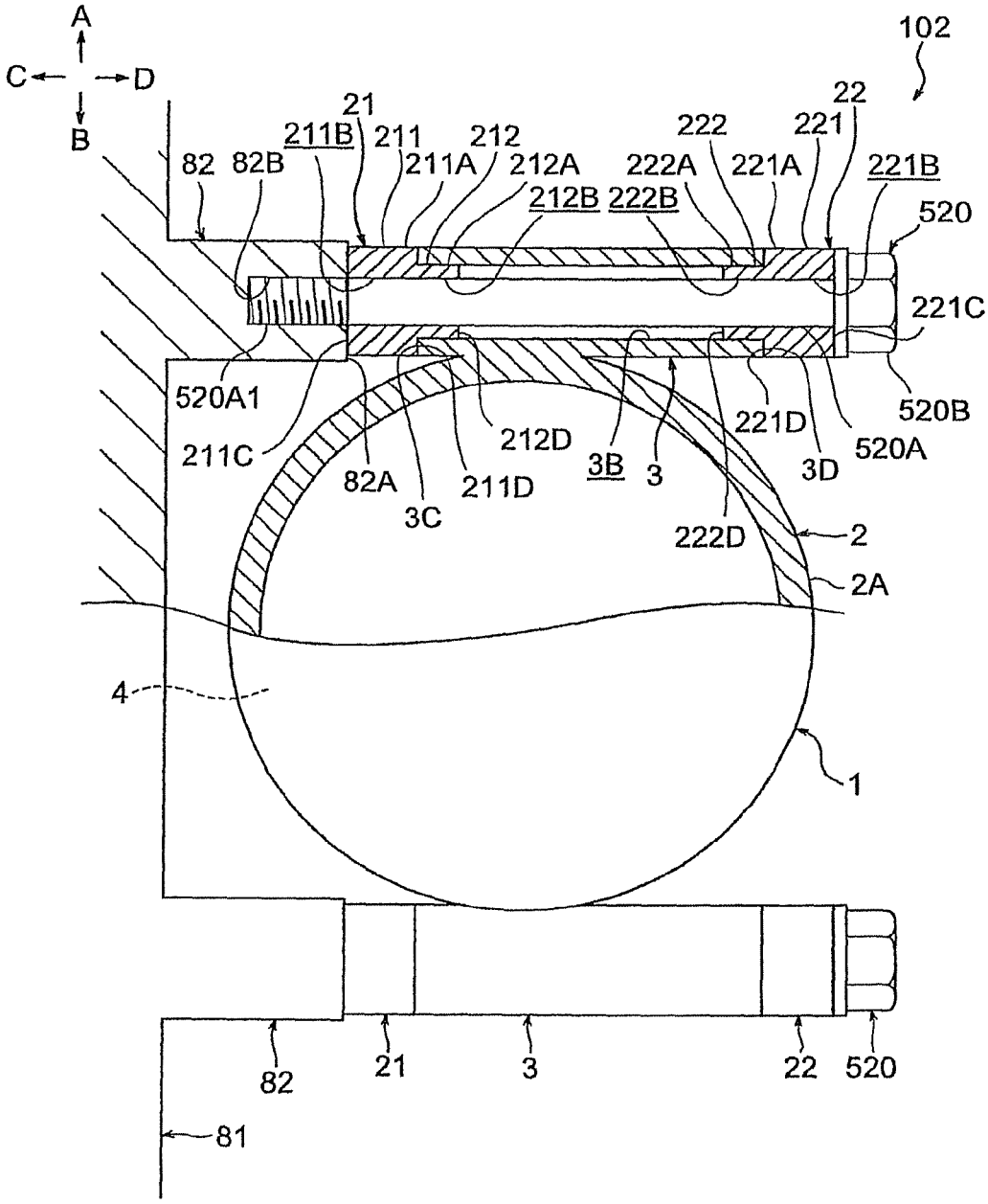
FIG. 3 is a schematic view showing a motor-driven compressor according to a second embodiment of the present invention.
Figure 4:
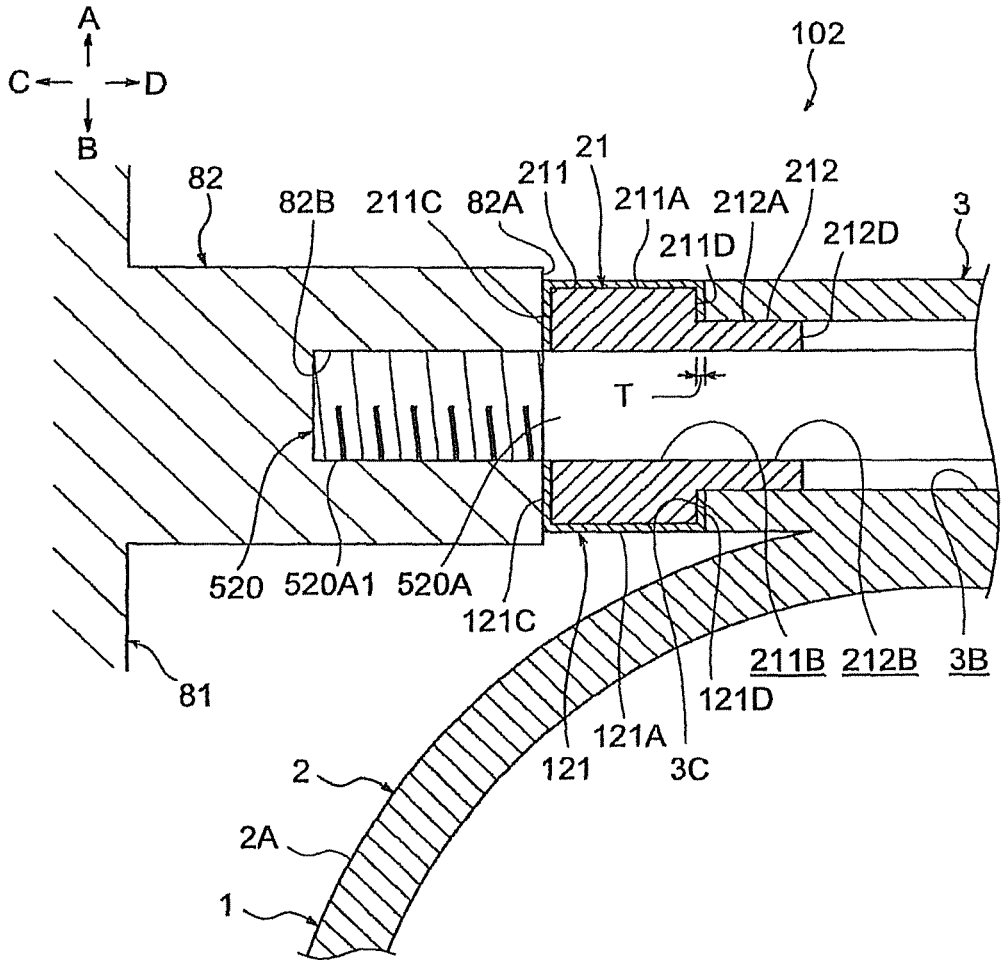
FIG. 4 is a sectional view showing a first spacer of the motor-driven compressor of FIG. 3 and its related parts.

The following will describe the motor-driven compressor according to the second embodiment of the present invention with reference to FIGS. 3 and 4. The second embodiment differs from the first embodiment in that a pair of spacers corresponding to the first spacer 11 of the first embodiment is provided on the opposite ends of the mounting tube 3 and the structure of the spacers is modified. For the sake of convenience of explanation, like or same parts or elements in the second embodiment will be referred to by the same reference numerals as those which have been used in the first embodiment, and the description thereof will be omitted.

Referring to FIG. 3 showing the motor-driven compressor 102 in schematic view, the mounting hole 3B of each mounting tube 3, which is formed integrally with the housing 2, has larger diameter than the shank 520A of the fastener 520 such as a screw. The fastener 520 of the second embodiment is made of a metal. A substantially cylindrical first spacer 21 is mounted to the left end 3C of the mounting tube 3 and a substantially cylindrical second spacer 22 is mounted to the right end 3D of the mounting tube 3. The first spacer 21 and the second spacer 22 are made of a resin as in the case of the first spacer 11 of the first embodiment.

The first spacer 21 has a cylindrical first support portion 211 whose outer circumferential surface 211A has a radius of curvature that is larger than the radius of the mounting hole 3B of the mounting tube 3 and a cylindrical first engaging portion 212 whose outer circumferential surface 212A is matched with the inner circumferential surface of the mounting hole 38. The first support portion 211 of the first spacer 21 has axially therethrough a hole 2118 and the first engaging portion 212 also has axially therethrough a hole 212B. The holes 211B and 212B are continuously formed and both have shapes matched with the outer circumferential surface of the shank 520A of the fastener 520. Thus, the first spacer 21 has an annular right end 211D located radially outward of the first engaging portion 212, an annular left end 211C having the same outside diameter as the annular right end 211D, and an annular right end 212D having an outside diameter smaller than that of the annular right end 211D.

The second spacer 22 has the same shape as the first spacer 21 and is mounted to the right end 3D of the mounting tube 3. As shown in FIG. 3, the second spacer 22 is located in symmetrical relation to the first spacer 21. The second spacer 22 has a cylindrical second support portion 221 whose outer circumferential surface 221A has a radius of curvature that is larger than the radius of the mounting hole 3B of the mounting tube 3 and a cylindrical second engaging portion 222 whose outer circumferential surface 222A is matched with the inner circumferential surface of the mounting hole 3B. The second support portion 221 has axially therethrough a hole 221B and the second engaging portion 222 also has axially therethrough a hole 222B. Thus, the second spacer 22 has an annular left end 221D located radially outward of the second engaging portion 222, an annular right end 221C having the same outside diameter as the annular left end 221D, and an annular left end 222D having an outside diameter that is smaller than that of the left end 221D.

Referring to FIG. 4, the first support portion 211 of the first spacer 21 is formed with a metal film 121. The metal film 121 has a first end portion 121C covering the left end 211C of the first support portion 211, an outer circumferential portion 121A covering the outer circumferential surface 211A of the first support portion 211 and a second end portion 121D covering the right end 211D of the first support portion 211. The first end portion 121C, the outer circumferential portion 121A and the second end portion 121D of the metal film 121 are continuously formed. The metal film 121 is made substantially the same as the metal film 111 of the first embodiment.

Referring to FIGS. 3 and 4, with the mounting tube 3 mounted in place to the mounting 82 of the engine 81 by the fastener 520, the left end 3C of the mounting tube 3 is in contact with the right end 211D of the first support portion 211 of the first spacer 21 via the second end portion 121D of the metal film 121 and the right end 3D of the mounting tube 3 is in contact with the left end 221D of the second support portion 221 of the second spacer 22. In addition, the left end 211C of the first support portion 211 of the first spacer 21 is in contact with the mounting surface 82A of the mounting 82 via the first end portion 121C of the metal film 121, and the right end 221C of the second support portion 221 of the second spacer 22 is in contact with the head 520B of the fastener 520. Thus, the first engaging portion 212 of the first spacer 21 and the second engaging portion 222 of the second spacer 22 are fitted between the inner circumferential surface of the mounting hole 3B of the mounting tube 3 and the outer circumferential surface of the shank 520A of the fastener 520.

The first spacer 21, the mounting tube 3 and the second spacer 22 receive the fastening force of the fastener 520. In addition, the first engaging portion 212 of the first spacer 21 and the second engaging portion 222 of the second spacer 22 radially support the shank 520A of the fastener 520 so that the shank 520A and the mounting tube 3 are spaced away from each other. The mounting tube 3 is electrically connected to the mounting 82 of the engine 81 via the metal film 121.

The vibration of the housing 2 is partially transmitted to the first spacer 21 via the mounting tube 3 and the metal film 121 having a small thickness T and low rigidity. The rest of the vibration of the housing 2 is transmitted to the second spacer 22 via the mounting tube 3. The vibration transmitted to the first spacer 21 and the second spacer 22 is dampened in the first spacer 21 and the second spacer 22 each having a high vibration damping performance. Thus, the vibration of the housing 2 is hard to be transmitted to the mounting 82 and hence to the engine 81 and the body of the vehicle via the engine 81. The first spacer 21 and the second spacer 22 which are made of a resin whose bending elastic modulus is not less than 100 MPa and not more than 10000 MPa resist deformation due to the vibration of the housing 2 and the mounting tube 3 and, therefore, the housing 2 remains in place without being displaced. Thus, the amplitude of the vibration of the housing 2 is prevented from increasing.

Referring to FIG. 4, any electric charge generated in the housing 2 by the fluid compression mechanism 4 is allowed to flow to the metal film 121 via the mounting tube 3. The electric charge flowing through the metal film 121 then flows to the engine 81 via the mounting 82 and then to the body of the vehicle. Thus, the metal films 121 serve to ground the motor-driven compressor 102. The rest of the structure and the operation of the motor-driven compressor 102 according to the second embodiment is substantially the same as that of the motor-driven compressor 101 according to the first embodiment and the description of such structure and operation will be omitted.

As described above, the motor-driven compressor 102 of the second embodiment includes the compressor body 1, a pair of the mounting tubes 3, a pair of the first spacers 21, a pair of the metal films 121, a pair of the fasteners 520 and a pair of the second spacers 22. Each mounting tube 3 is formed on the compressor body 1 and has a mounting hole 3B. Each first spacer 21 is made of a resin and interposed between its corresponding mounting 82 and the mounting tube 3. Each metal film 121 is formed integrally with the first spacer 21 for electrically connecting the mounting 82 and the mounting tube 3. In addition, the metal film 121 is flexible and electrically conductive. Each fastener 520 is inserted through the mounting hole 3B of the mounting tube 3 in the mounting 82 for joining the mounting 82 and the mounting tube 3. Each second spacer 22 is made of a resin and interposed between the mounting tube 3 and the fastener 520.

Thus, the vibration developed by the compressor body 1 is transmitted to the first spacer 21 and the second spacer 22 via the mounting tube 3. The first spacer 21 and the second spacer 22 are both made of a resin having a high vibration damping performance. Therefore, the vibration transmitted to the first spacer 21 and the second spacer 22 is dampened in the first spacer 21 and the second spacer 22. The metal film 121 formed integrally with the first spacer 21 electrically connects the mounting tube 3 and the mounting 82, so that the metal film 121 serves to ground the motor-driven compressor 102. Therefore, the motor-driven compressor 102 of the second embodiment offers substantially the same effects as the motor-driven compressor 101 of the first embodiment.

In the motor-driven compressor 102, the first spacer 21 and the second spacer 22 have the first engaging portion 212 and the second engaging portion 222, respectively, fitted between the mounting hole 3B of the mounting tube 3 and the fastener 520 for spacing away the mounting tube 3 and the fastener 520 from each other. In this structure, the mounting tube 3 and the shank 520A of the fastener 520 are held at a distance without being moved relative to each other. Any vibration transmission from the mounting tube 3 to the fastener 520 due to the contact between the mounting tube 3 and the shank 520A is prevented. In the motor-driven compressor 102 wherein the bending elastic modulus of the resin of the first spacer 21 and the second spacer 22 is not less than 100 MPa and not more than 10000 MPa, the mounting tube 3 is rigid enough to maintain the mounting tube 3 and the compressor body 1 in place without being moved, which prevents the amplitude of the vibration of the compressor body 1 from increasing.

In the motor-driven compressor 102 wherein the first spacer 21 and the second spacer 22 are provided on the opposite ends of the mounting tube 3, the vibration of the mounting tube 3 is hard to be transmitted to the fastener 520. Thus, a fastener made of a metal may be used for the fastener 520, so that the fastening force of the fastener 520 may be increased, which increases the strength of mounting the mounting tube 3 to the mounting 82.

Figure 5:
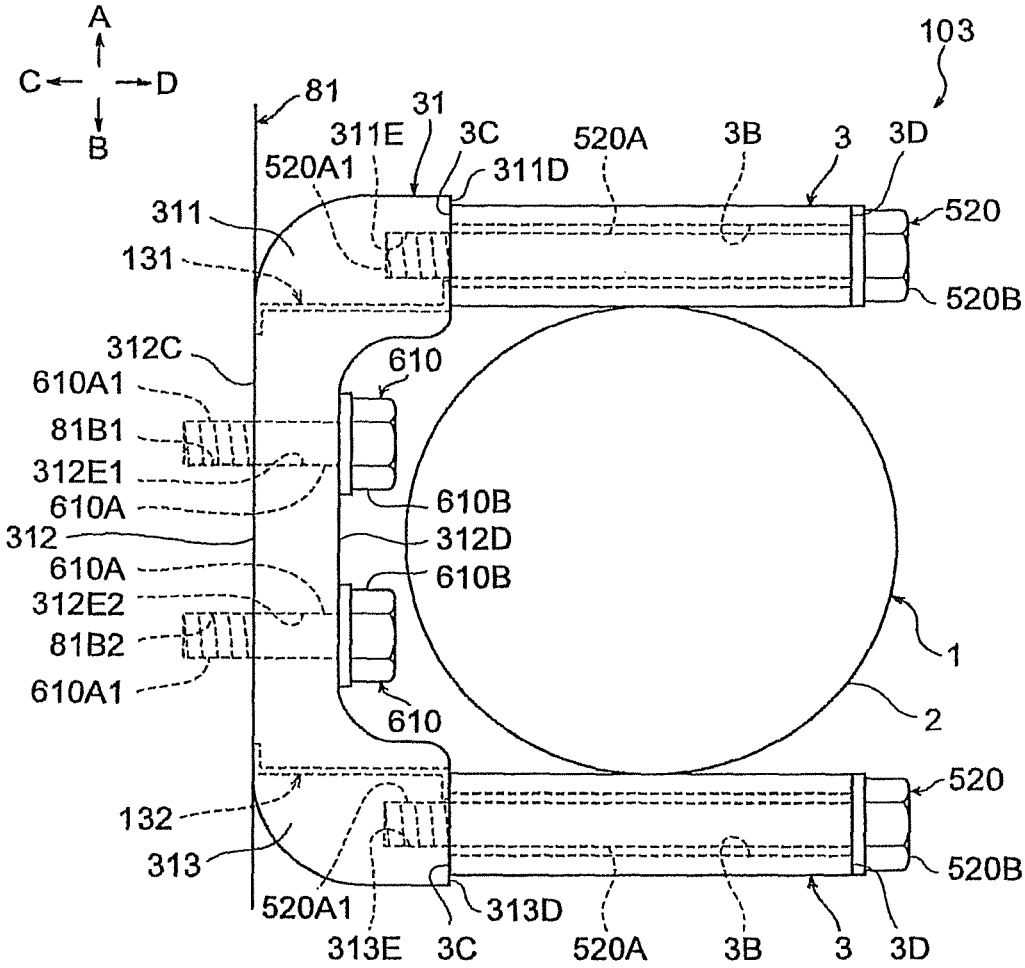
FIG. 5 is a schematic view showing a motor-driven compressor according to a third embodiment of the present invention.

The following will describe the motor-driven compressor according to the third embodiment of the present invention with reference to FIG. 5. The motor-driven compressor 103 of the third embodiment differs from the motor-driven compressor 101 of the first embodiment in that a single spacer corresponding to the paired first spacers 11 of the first embodiment is connected to the paired mounting tubes 3.

Referring to FIG. 5, the motor-driven compressor 103 of the third embodiment includes a spacer 31 connected to the paired mounting tubes 3 provided on the opposite sides of the housing 2. The spacer 31 has substantially a U-shape as shown in FIG. 5. The spacer 31 is made of the same resin as that used for the first spacer 11 of the first embodiment and serves as the first spacer of the present invention. The spacer 31 has an upper end portion 311, a lower end portion 313 and a straight middle portion 312 between the upper end portion 311 and the lower end portion 313. The right ends of the upper end portion 311 and the lower end portion 313 are located rightward of the middle portion 312.

The middle portion 312 has on the right and left sides thereof outer surfaces 312D and 312C, respectively, and has axially therethrough an upper hole 312E1 and a lower hole 312E2. The upper end portion 311 has at the right end thereof a mounting surface 311D and therein an internally threaded hole 311E. Similarly, the lower end portion 313 has at the right end thereof a mounting surface 313D and therein an internally threaded hole 313E. The spacer 31 has therein a first metal member 131 and a second metal member 132 which are formed integrally with the spacer 31 by resin molding such as insert molding.

The first metal member 131 extends from the mounting surface 311D of the upper end portion 311 to the outer surface 312C of the middle portion 312 and is exposed at the mounting surface 311D and the outer surface 312C. Similarly, the second metal member 132 extends from the mounting surface 313D of the lower end portion 313 to the outer surface 312C of the middle portion 312 and is exposed at the mounting surface 313D and the outer surface 312C. The first metal member 131 and the second metal member 132 are made of a metal in the form of a line, fiber, rod or sheet. The first metal member 131 and the second metal member 132 have flexibility, low rigidity and electrical conductivity. The first metal member 131 and the second metal member 132 serve as the conductor of the present invention.

The engine 81 has therein internally threaded holes 81B1 and 81B2. The engine 81 serves as the first mounting of the present invention. The spacer 31 is fixed to the engine 81 by two fasteners 610 such as screws each having an external thread 610A1 on its shank 610A. In the third embodiment, each fastener 610 is made of a metal. To fix the spacer 31 to the engine 81, with the outer surface 312C of the spacer 31 set in contact with the engine 81, the shanks 610A of the fasteners 610 are inserted through the upper hole 312E1 and the lower hole 312E2 of the middle portion 312, respectively. Then, the fasteners 610 are screwed into the internally threaded holes 81B1 and 81B2 of the engine 81, respectively, thereby to fasten the spacer 31 to the engine 81. Thus, the spacer 31 is fixed to the engine 81. The fasteners 610 serve as the second fastener of the present invention.

Fixing the mounting tubes 3 of the compressor body 1 to the upper end portion 311 and the lower end portion 313 of the spacer 31, respectively, the motor-driven compressor 103 is mounted on the engine 81. To fix the upper mounting tube 3 to the upper end portion 311 of the spacer 31, with the left end 3C of the mounting tube 3 set in contact with the mounting surface 311D of the upper end portion 311, the shank 520A of the fastener 520 is inserted through the mounting hole 3B of the mounting tube 3. Then, the fastener 520 is screwed into the internally threaded hole 311E of the upper end portion 311 thereby to fasten the mounting tube 3 to the upper end portion 311. Similarly, the lower mounting tube 3 is fastened to the lower end portion 313. Thus, the compressor body 1 is fixed to the spacer 31. The fasteners 520 serve as the first fastener of the present invention.

With the spacer 31 fixed to the engine 81 and the compressor body 1 fixed to the spacer 31, the first metal member 131 and the second metal member 132 are in contact with the mounting tubes 3 and the engine 81 thereby to electrically connect the mounting tubes 3 and the engine 81.

The vibration of the housing 2 is transmitted to the spacer 31 via the mounting tubes 3 and dampened in the spacer 31 having a high vibration damping performance. The first metal member 131 and the second metal member 132 having a low rigidity are hard to allow the vibration of the mounting tubes 3 to be transmitted to the engine 81. Thus, the vibration of the housing 2 is hard to be transmitted to the engine 81 and hence to the body of the vehicle via the engine 81. The spacer 31 which is made of a resin whose bending elastic modulus is not less than 100 MPa and not more than 10000 MPa resists deformation due to the vibration of the housing 2 and the mounting tubes 3, so that no displacement of the housing 2 occurs. Thus, the amplitude of the vibration of the housing 2 is prevented from increasing.

Any electric charge generated in the housing 2 by the fluid compression mechanism 4 is allowed to flow to the first metal member 131 and the second metal member 132 via the mounting tubes 3. The electric charge flowing through the first metal member 131 and the second metal member 132 then flows to the body of the vehicle via the engine 81. Thus, the first metal member 131 and the second metal member 132 serve to ground the motor-driven compressor 103. The rest of the structure and the operation of the motor-driven compressor 103 according to the third embodiment is substantially the same as those of the motor-driven compressor 101 according to the first embodiment and the description of such, structure and operation will be omitted.

As described above, the motor-driven compressor 103 of the third embodiment is mounted on the engine 81 and includes the compressor body 1, a pair of the mounting tubes 3, the spacer 31, the first metal member 131, the second metal member 132, a pair of the fasteners 520 and a pair of the fasteners 610. Each mounting tube 3 is formed on the compressor body 1 and has a mounting hole 3B. The spacer 31 is made of a resin and interposed between the engine 81 and the mounting tubes 3. Each of the first metal member 131 and the second metal member 132 is formed integrally with the spacer 31 for electrically connecting the engine 81 and the mounting tube 3. In addition, the first metal member 131 and the second metal member 132 are flexible and electrically conductive. Each fastener 520 is inserted through the mounting hole 3B of the mounting tube 3 in the spacer 31 for joining the spacer 31 and the mounting tube 3. Each fastener 610 joins the engine 81 and the spacer 31.

Thus, the vibration developed in the compressor body 1 is transmitted to the spacer 31 via the mounting tubes 3. The spacer 31 which is made of a resin and has a high vibration damping performance dampens the vibration transmitted to the spacer 31. The first metal member 131 and the second metal member 132 formed integrally with the spacer 31 electrically connect the respective mounting tubes 3 and the engine 81, so that the first metal member 131 and the second metal member 132 serve to ground the motor-driven compressor 103. Thus, the motor-driven compressor 103 of the third embodiment offers substantially the same effects as the motor-driven compressor 101 of the first embodiment.

In the motor-driven compressor 103 wherein the bending elastic modulus of the resin of the spacer 31 is not less than 100 MPa and not more than 10000 MPa, the mounting tube 3 is rigid enough to maintain the mounting tube 3 and the compressor body 1 in place without being moved, which prevents the amplitude of the vibration of the compressor body 1 from increasing. In the motor-driven compressor 103 wherein the fasteners 520 for fixing the mounting tubes 3 and the fasteners 610 for fixing the spacer 31 are made of a metal, the strength of mounting the mounting tubes 3 to the spacer 31 is increased. In the motor-driven compressor 103 wherein the first metal member 131 and the second metal member 132 are disposed in the spacer 31, deterioration of such metal members caused by rust or corrosion is reduced and, therefore, the grounding function of the motor-driven compressor 103 is enhanced. In the motor-driven compressor 103, the first metal member 131 and the second metal member 132 may be disposed on the outer surface of the spacer 31.

In the second embodiment, the first spacer 21 has the first engaging portion 212, the second spacer 22 has the second engaging portion 222, and the first engaging portion 212 and the second engaging portion 222 are fitted between the mounting hole 3B of the mounting tube 3 and the shank 520A of the fastener 520. According to the present invention, however, the first spacer 21 and the second spacer 22 are not limited to such structure. The first spacer 21 and the second spacer 22 may have the same shape as the first spacer 11 of the first embodiment without such engaging portions.

In the first embodiment, the metal film 111 is formed so as to cover the entirety of the left end 11C, the outer circumferential surface 11A and the right end 11D of the first spacer 11. In the second embodiment, the metal film 121 is formed so as to cover the entirety of the left end 211C, the outer circumferential surface 211A and the right end 211D of the first spacer 21. However, the metal films 111 and 121 are not limited to such structure. In the first embodiment, the metal film 111 may be formed so as to cover a part of the left end 11C, the outer circumferential surface 11A and the right end 11D of the first spacer 11 for electrically connecting the mounting tube 3 and the mounting 82. In the second embodiment, the metal film 121 may be formed so as to cover a part of the left end 211C, the outer circumferential surface 211A and the right end 211D of the first spacer 21 for electrically connecting the mounting tube 3 and the mounting 82. In the first and second embodiments, the metal film 111 is formed on the outer circumferential surface 11A of the first spacer 11 and the metal film 121 is formed on the outer circumferential surface 211A of the first spacer 21. However, the metal films 111 and 121 are not limited to such structure. The metal film 111 may be formed in the hole 11B of the first spacer 11 or in the first spacer 11. The metal film 121 may be formed in the holes 211B and 212B of the first spacer 21 or in the first spacer 21. Thus, as in the case of the motor-driven compressor 103, deterioration of the metal films 111 and 121 caused by rust or corrosion is reduced and, therefore, the grounding function of the motor-driven compressor 103 is enhanced.

In the first and second embodiments, the metal films 111 and 121 are used for grounding the motor-driven compressors 101 and 102, respectively. However, the conductor is not limited to such metal films 111 and 121. The conductor may be made in various forms other than the metal films, such as a line, fiber or rod. In the first through third embodiments, the mounting tube 3 is mounted in the motor-driven compressor mounted on the internal combustion engine 81 installed in a vehicle. However, the mounting tube 3 is not limited to such structure. The mounting tube 3 may be mounted in a motor-driven compressor on an electric traction motor installed in a fuel cell powered vehicle or electric vehicle. The motor-driven compressor of the present invention is not limited to a refrigerant compressor in a refrigeration system, but may be used for various applications. The motor-driven compressor may be any air compressor used in air-suspension system of vehicle, or any pump mounted in the fuel cell powered vehicle for pumping hydrogen or air to a stack.

What is claimed is:

1. A motor-driven compressor mounted on a first mounting of a vehicle, comprising:

a compressor body being electrically powered to draw in fluid for compression and to discharge the compressed fluid;

a second mounting formed on the compressor body and having a mounting hole;

a first spacer made of a resin and interposed between the first mounting and the second mounting, the first spacer having a hole;

a flexible conductor formed integrally with the first spacer for electrically connecting the first mounting and the second mounting, wherein the conductor is formed in the hole of the first spacer or in the first spacer so that an entirety of the conductor is covered by the first spacer; and a fastener made of a resin and inserted through the mounting hole of the second mounting for joining the first mounting and the second mounting.

2. The motor-driven compressor according to claim 1, wherein the resin has a bending elastic modulus of not less than 100 MPa and not more than 10000 MPa.

3. The motor-driven compressor according to claim 1, wherein the conductor is a metal film that is formed so as to cover opposite ends of the first spacer and an outer circumferential surface of the first spacer.

4. A motor-driven compressor mounted on a first mounting of a vehicle, comprising:

a compressor body being electrically powered to draw in fluid for compression and to discharge the compressed fluid;

a second mounting formed on the compressor body and having a mounting hole;

a first spacer made of a resin and interposed between the first mounting and the second mounting, the first spacer having a hole;

a flexible conductor formed integrally with the first spacer for electrically connecting the first mounting and the second mounting, wherein the conductor is formed in the hole of the first spacer or in the first spacer so that an entirety of the conductor is covered by the first spacer;

a fastener inserted through the mounting hole of the second mounting for joining the first mounting and the second mounting; and a second spacer made of a resin and interposed between the second mounting and the fastener.

5. The motor-driven compressor according to claim 4, wherein the first spacer has a first engaging portion and the second spacer has a second engaging portion, and wherein the first engaging portion and the second engaging portion are fitted between the mounting hole of the second mounting and the fastener for spacing away the second mounting and the fastener from each other.

6. The motor-driven compressor according to claim 4, wherein the resin has a bending elastic modulus of not less than 100 MPa and not more than 10000 MPa.

7. The motor-driven compressor according to claim 4, wherein the first spacer has a cylindrical support portion whose outer circumferential surface has a radius of curvature that is larger than the radius of the mounting hole of the second mounting, wherein the conductor is a metal film that is formed so as to cover opposite ends of the support portion and the outer circumferential surface of the support portion.

8. A motor-driven compressor mounted on a first mounting of a vehicle, comprising:

a compressor body being electrically powered to draw in fluid for compression and to discharge the compressed fluid;

a second mounting formed on the compressor body and having a mounting hole;

a first spacer made of a resin and interposed between the first mounting and the second mounting;

a flexible conductor formed integrally with the first spacer for electrically connecting the first mounting and the second mounting, wherein the conductor is formed in the first spacer so that an entirety of the conductor is covered by the first spacer;

a first fastener inserted through the mounting hole of the second mounting for joining the first spacer and the second mounting; and a second fastener for joining the first mounting and the first spacer.

9. The motor-driven compressor according to claim 8, wherein the resin has a bending elastic modulus of not less than 100 MPa and not more than 10000 MPa.

10. The motor-driven compressor according to claim 8, wherein the conductor is a metal member.

* * * * *